US007117900B2

(12) United States Patent
Lam et al.

(10) Patent No.: US 7,117,900 B2
(45) Date of Patent: Oct. 10, 2006

(54) ELASTIC WOVEN TAPE AND A METHOD OF FORMING SAME

(75) Inventors: Ah Ping Lam, Guangdong (CN); Hsiao Hui Liu, Guangdong (CN)

(73) Assignee: Pioneer Elastic Fabric Ltd., New Territories (HK)

( * ) Notice: Subject to any disclaimer, the term of this patent is extended or adjusted under 35 U.S.C. 154(b) by 0 days.

(21) Appl. No.: 10/885,098

(22) Filed: Jul. 7, 2004

(65) Prior Publication Data

US 2005/0106972 A1 May 19, 2005

(30) Foreign Application Priority Data

Nov. 17, 2003 (CN) ..... 2003 1 01121486

(51) Int. Cl.
*D03D 15/08* (2006.01)
*D03D 17/00* (2006.01)

(52) U.S. Cl. ..... 139/421; 139/422; 442/486

(58) Field of Classification Search ..... 139/421, 139/422; 442/486, 186
See application file for complete search history.

(56) References Cited

U.S. PATENT DOCUMENTS 2,260,052 A * 10/1941 Passavant ..... 428/102
3,124,725 A * 3/1964 Leguillon ..... 335/303
3,461,025 A * 8/1969 Coleman et al. ..... 442/3
3,730,233 A 5/1973 Goff et al.
4,009,597 A * 3/1977 Wall et al. ..... 66/193
4,097,631 A * 6/1978 Wilken ..... 428/114
4,368,234 A * 1/1983 Palmer et al. ..... 442/186
4,787,381 A * 11/1988 Hubbard et al. ..... 602/44
5,164,250 A * 11/1992 Paz Rodriguez ..... 442/186
5,395,665 A * 3/1995 Planeta ..... 428/36.1
5,749,843 A * 5/1998 Miller ..... 602/75
5,763,069 A * 6/1998 Jordan ..... 428/323
5,963,988 A * 10/1999 Jackson, Jr. ..... 2/243.1
6,539,983 B1 * 4/2003 Khokar ..... 139/383 A
6,817,384 B1 * 11/2004 Chang ..... 139/424

FOREIGN PATENT DOCUMENTS

JP 10-195733 7/1998

OTHER PUBLICATIONS

Correspondence describing Cheynet et Fils Product No. 9356/12, Sep. and Oct. 1999.

* cited by examiner

*Primary Examiner*—John J. Calvert
*Assistant Examiner*—Robert H Muromoto
(74) *Attorney, Agent, or Firm*—Buchanan Ingersoll & Rooney PC

(57) ABSTRACT

An elastic woven tape is disclosed as being composed of at least two kinds of tape sections, each of which having a respectively different elongation and/or modulus, and formed by alternating and continuous integration of these two kinds of tape sections by weaving. The weaving method of the said elastic woven tape includes controlling the changes in the degrees of elasticity provided by elastic threads for the woven tape in mechanized weaving through the control of the feeding speeds of the elastic threads. The advantageous effects of this invention lie in the production of a woven tape composed of tape sections respectively with larger elongation but smaller modulus and with smaller elongation but larger modulus by means of their alternating and continuous integration by weaving, which simplifies the post-weaving operation and improves production efficiency. The resultant woven tape has no connections or joints, which assures the overall beauty of the apparel with the woven tape and the comfort of the apparel in wearing.

1 Claim, 2 Drawing Sheets

*Fig. 4*
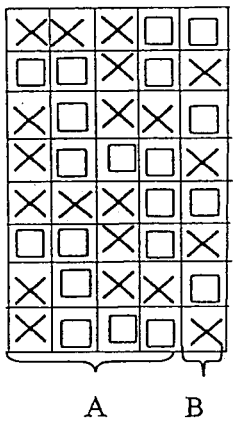
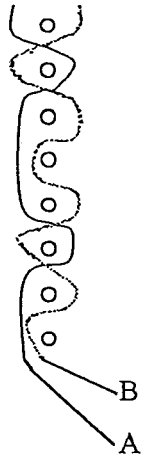
*Fig. 6*
*Fig. 5*
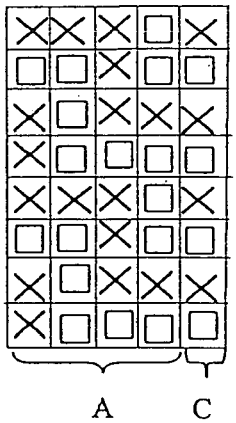
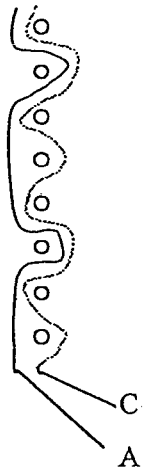
*Fig. 7*

ELASTIC WOVEN TAPE AND A METHOD OF FORMING SAME

FIELD OF THE INVENTION

This invention involves an elastic woven tape, and a method forming such an elastic woven tape.

BACKGROUND OF THE INVENTION

Elastic woven tapes are extensively used in the textile industry and other aspects of daily life, of which they are particularly widely used in the garment industry. Elastic woven tape is an essential accessory for the underwear industry. Existing elastic woven tape has basically an even degree of elongation and modulus along the direction of its length. However, in actual use, an elastic woven tape is usually required to be composed of at least two kinds of tape sections, each of which having an appropriate elongation and modulus. For example, a tape section with a larger elongation but smaller strength is required for the part of the shoulder strap of an underwear, e.g. a brassiere, which is in touch with the shoulder, so that the user will feel comfortable during movement of her shoulder, whereas a tape section with a smaller elongation but larger modulus is required for the remaining part of the shoulder strap of the underwear, so as to achieve the supporting strength required for large bra cups. The current practice is to integrate a tape section with larger elongation but smaller modulus with another tape section with smaller elongation but larger modulus by sewing. This manner of production is both trifling and rather inefficient. This will not only leave joints on the tapes, spoiling its whole appearance, but also bring discomfort to the wearer.

It is thus an object of the present invention to provide an elastic woven tape, and a method of weaving such an elastic woven tape, in which the aforesaid shortcomings are mitigated, or at least to provide a useful alternative to the public.

SUMMARY OF THE INVENTION

According to a first aspect of the present invention, there is provided an elastic woven tape comprising at least two types of tape sections, each having a respective elongation and modulus, wherein said at least two types of tape sections are alternately and continuously integrated with each other into said elastic woven tape by weaving.

According to a second aspect of the present invention, there is provided a method of forming an elastic woven tape, including the steps of (a) providing at least two types of tape sections, each having a respective elongation and modulus; and (b) integrating said at least two types of tape sections alternately and continuously with each other into said elastic woven tape by weaving.

The advantages of this invention reside mainly in the production of a woven tape composed of tape sections respectively with larger elongation but smaller modulus and with smaller elongation but larger modulus by means of their alternating and continuous integration by weaving, which simplifies the post-weaving operation and improves production efficiency. The resultant woven tape has no connections or joints, which assures the overall beauty of the wearing apparel with the woven tape and the comfort in wearing the apparel.

BRIEF DESCRIPTION OF THE DRAWINGS

Preferred embodiments of the present invention will now be described, by way of examples only, with reference to the accompanying drawings, in which:

FIG. 4 shows the weave structure of a woven tape with relatively smaller elongation;

FIG. 5 shows the weave structure of a woven tape with relatively larger elongation;

FIG. 6 is a sectional view of the relative position of any of the warp threads in series B and series A.

FIG. 7 is the sectional view of the relative position of any of the warp threads in series C and series A.

DETAILED DESCRIPTION OF PREFERRED EMBODIMENTS

Figure 1:
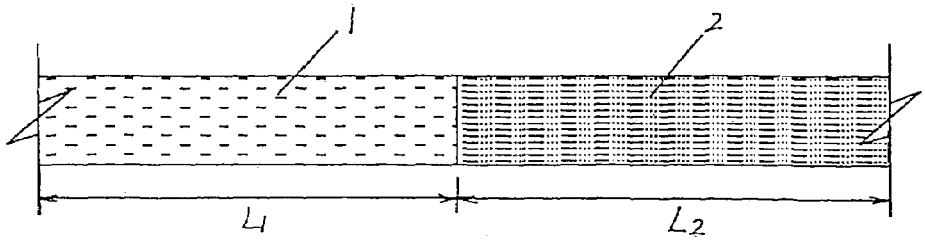
FIG. 1 is a structural diagram of a first embodiment of an elastic woven tape according to the present invention.

An elastic woven tape according to a first preferred embodiment of the present invention is composed alternately of tape sections of respectively different elongation and/or modulus. As shown in FIG. 1, the elastic woven tape is composed alternately of a tape section 1 of larger elongation but smaller modulus and tape section 2 is of smaller elongation but larger modulus. This elastic woven tape is woven with a Swiss Muller shuttleless loom and in weaving, the speed of feeding the elastic threads are controlled with an elastic thread feeding control device as shown in FIG. 4, so as to control the changes in the degrees of the elasticity caused by elastic threads to the woven tape, in order to produce, by weaving, a woven tape composed of alternating tape sections with larger elongation but smaller modulus and tape sections with smaller elongation but larger modulus.

Turning to the operating principle of the elastic thread feeding control device shown in FIG. 4, it can be seen that a metal plate 31 is placed on a heddle twine 8 of the shuttleless loom. A sensor 32 inputs induced signals into a sensor controller 33 after it has sensed the metal plate 31. The controller 33 processes the induced signals and controls a straight-line operating motor 41. The straight-line operating motor 41 changes the spatial position of a pair of metal rods 5 through a variable-tension extension lever 42 on it. Another sensor 61 senses the change in the position of the metal rod pair 5, and inputs signals into another sensor controller 62. The sensor controller 62 processes the signals and controls a driving elastic thread feeding motor 71. The motor 71 drives an elastic thread feeding device 72 and a change in the operating speed of the feeding device 72 can lead to a change in the feeding speeds of the elastic threads 9. A large-tension limit switch 43 and a small-tension limit switch 44 fixed on the variable tension extension link 42 are for limiting the maximum and minimum speeds of feeding the elastic threads 9.

Figure 2:
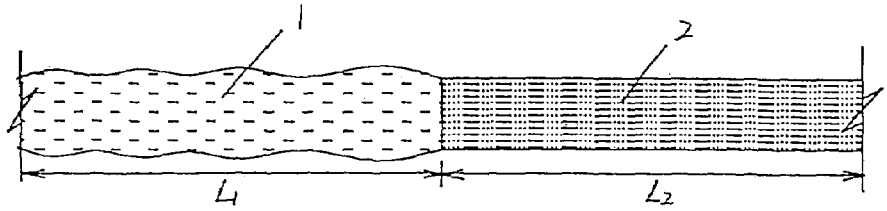
FIG. 2 is structural diagram of a second embodiment of an elastic woven tape according to the present invention.
Figure 3:
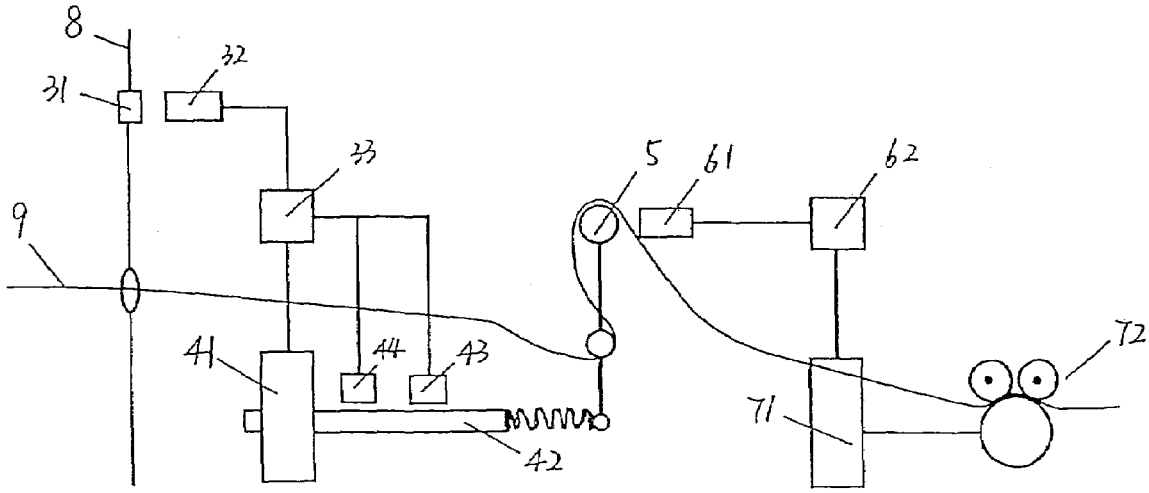
FIG. 3 is a schematic diagram of a spandex thread feeding control device used in the production of the elastic woven tapes according to the present invention.

As shown in FIG. 2, an elastic woven tape according to a second preferred embodiment of the present invention is composed of tape sections 1 with larger elongation but smaller modulus and tape sections 2 with smaller elongation but larger modulus, again in an alternating manner. This elastic woven tape is also woven with a Swiss Muller shuttleless loom and a stitch structure is used along the direction of the length of the woven tape to change the degrees of the elasticity of the elastic threads of the tape, resulting in a woven tape composed of alternating tape sections with larger elongation but smaller strength and those with smaller elongation but larger strength, which are integrated by weaving.

FIG. 4 and FIG. 5 are diagrams used in the textile industry to indicate the weave pattern or structure of a fabric, in which the symbol "×" means that warp threads are above weft threads, whereas the symbol "□" means that warp threads are underneath weft threads. The weave structure shown in FIG. 4 is composed of series A and series B and can be used for weaving tape sections of larger elongation but smaller modulus; whereas the stitch structure shown in FIG. 5 is composed of series A and series C, and can be used for weaving tape sections of smaller elongation but larger modulus. The weave structure of series A is used for the elastic threads in both the tape sections 1 and tape sections 2, while the weave structures of series B and series C are used for other materials. The differences of the weave structures of the series B and the series C lie in the fact that, as shown in FIG. 6, the warp threads in the series B crisscross with any of the warp threads in the series A, so the elastic threads can only yield relatively smaller elasticity; whereas as shown in FIG. 7, there are no crisscrosses between the warp threads in the series C and any of the warp threads in the series A, so the elastic threads can provide relatively larger elasticity. The stitch structures in FIG. 4 and FIG. 5 are used in an alternating manner along the direction of the length of the woven tape, thus resulting in an integrated woven tape with two kinds of tape sections respectively with larger and smaller elongation.

It should be understood that the above only illustrates and describes examples whereby the present invention may be carried out, and that modifications and/or alterations may be made thereto without departing from the spirit of the invention.

It should also be understood that certain features of the invention, which are, for clarity, described in the context of separate embodiments, may also be provided in combination in a single embodiment. Conversely, various features of the invention which are, for brevity, described in the context of a single embodiment, may also be provided or separately or in any suitable subcombination.

What is claimed is:

1. A method of forming an elastic woven tape, including the steps of:

(a) providing at least two types of tape sections, each having a respective elongation and modulus;

(b) integrating said at least two types of tape sections alternately and continuously with each other into said elastic woven tape by weaving; and (c) operating a thread feeding control device to control the speed of thread feeding;

wherein said thread feeding control device includes at least one metal plate, at least two sensors, at least two sensor controllers, at least one straight-line operating motor, at least a pair of rods, at least one thread feeding motor, and at least one thread feeding device, wherein, during operation, a first of said at least two sensors inputs signals into a first of said at least two sensor controllers after having sensed said metal plate, wherein said first sensor controller processes the signals and controls said straight-line operating motor, wherein said motor changes the spatial position of said pair of rods, and wherein a second of said at least two sensors senses the change in the position of said pair of rods, and inputs signals into a second of said at least two sensor controllers, and wherein said second sensor controller processes the signals and controls said thread feeding motor, which in turn drives said thread feeding device.

* * * * *